United States Patent [19]

Sussman

[11] Patent Number: 4,541,131

[45] Date of Patent: Sep. 17, 1985

[54] COMBINATION BATH AND SHOWER ACCESSORY

[76] Inventor: Howard Sussman, 3101 NW. 25th Ave., Pompano Beach, Fla. 33060

[21] Appl. No.: 635,509

[22] Filed: Jul. 30, 1984

[51] Int. Cl.[4] ..... A47F 5/08

[52] U.S. Cl. ..... 4/596; 211/2; 211/113; 211/119

[58] Field of Search ..... 4/596, 597, 605, 191; 211/113, 119, 2

[56] References Cited

U.S. PATENT DOCUMENTS 3,789,996 2/1974 Stroh ..... 211/119

FOREIGN PATENT DOCUMENTS 2840880 3/1980 Fed. Rep. of Germany ..... 211/113

*Primary Examiner*—Stephen Marcus
*Assistant Examiner*—Leo J. Peters
*Attorney, Agent, or Firm*—Bauer & Amer; Bauer & Amer

[57] ABSTRACT

An open rectangular frame with object-storing trays slidably and rotatably mounted in spanning relation between the long sides of the frame, and opposite extending supports from said frame which enable the frame to be horizontally oriented across the sides of a bathtub and thus function as a bath accessory, and when only one extended support is used, the same is effective to vertically suspend the frame from the shower nozzle or the like, and thereby contribute to its functioning as a shower accessory, and wherein the trays are appropriately rotated in accordance with the horizontal or vertical orientation of the frame.

2 Claims, 6 Drawing Figures

COMBINATION BATH AND SHOWER ACCESSORY

The present invention relates to a combination bath and shower accessory and, more particularly, to a novel article of manufacture for storing soap, brushes and other sundries typically used during showering or bathing.

While soap, brushes and the like are typically used both when showering and when bathing, the standing and sitting positions used during these activities has heretofore required the use of separate storage units for these objects, in order that they be within the convenient reach of the user.

Broadly, it is an object of the present invention to provide a single, but convertible, unit for soap, etc. storage during showering and bathing, and thereby overcoming the foregoing and other shortcomings of the prior art. More particularly, it is an object to provide an object-storing frame for soap, etc., which has either a vertical or horizontal mode, the former mode enabling it to serve as a shower accessory when suspended from the shower nozzle or the like, and the latter mode enabling it to be supported across the sides of a bathtub when serving as a bath accessory.

An article of manufacture for combined use as a bath and shower accessory demonstrating objects and advantages of the present invention includes a rectangular frame having in the long sides thereof a pair of opposing faces each having at least one longitudinally oriented slot therein. Plural trays are mounted in spanning relation between said frame long sides and each has opposite cylindrical lateral projections operatively disposed in the frame slot so as to partake of selected sliding movement therealong and also rotative movement about the axis of said cylindrical lateral projections. Completing the construction of the article are slidable supports extendable in opposite directions from the frame such that when a cooperating pair thereof are in their extended position, the frame is adapted to be horizontally supported thereon, and when only one said support is in its extended position, the frame is adapted to be vertically suspended therefrom. As a result, the horizontally supported frame with said trays in one rotative position is adapted to be supported in spanning relation between the sides of a bathtub when serving as a bath accessory, and it is also adapted when vertically suspended from only one support, and with said trays in a 90 degree rotated position, to serve as a shower accessory.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
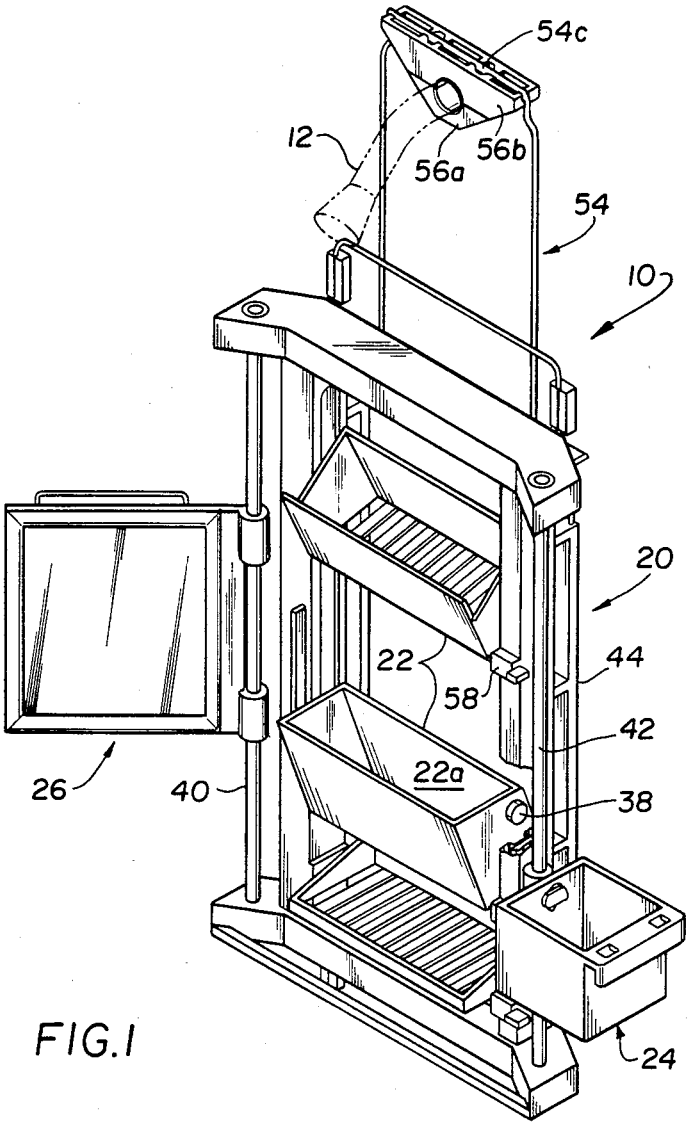
FIG. 1 is a front, right isometric view of the within inventive device in its vertical mode when serving as a shower accessory and with all of the trays and other attachments thereon, and with a portion thereof broken away to illustrate a cylindrical projection on one of the trays.
Figure 2:
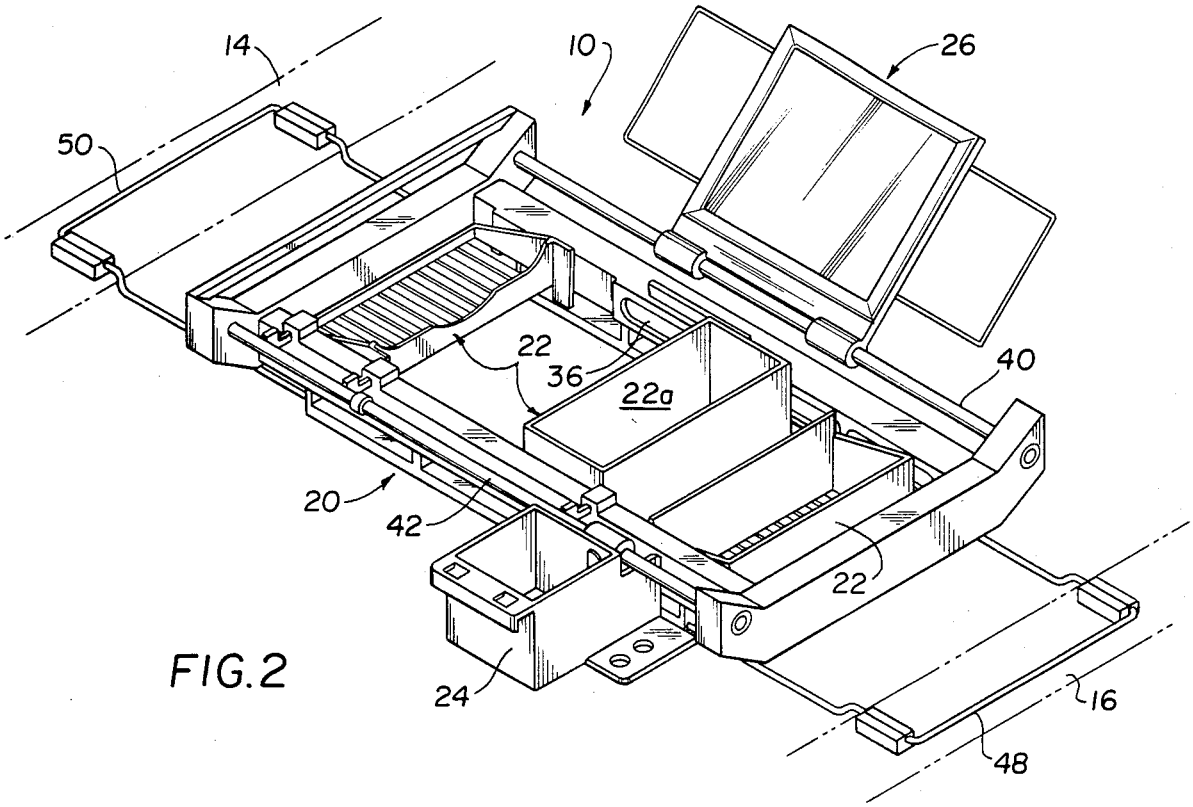
FIG. 2 is a front, right isometric view of the device in its horizontal mode when serving as a bath accessory, and again, with all of its trays and attachments thereon.

As may be best appreciated from a comparison of FIGS. 1 and 2, the within inventive device, generally designated 10, is an article of manufacture which is adapted to be suspended vertically from a shower nozzle 12 or other elevated point of support, as illustrated in FIG. 1, and as such effectively serves as a shower accessory, and, when supported horizontally as between the sides 14 and 16 of a bathtub, as illustrated in FIG. 2, effectively serves as a bath accessory. The versatility of the device 10 to serve both of these needs is primarily the result of a unique rectangular frame generally designated 20, which mounts selected trays, individually and collectively designated 22, for storing articles, such as soap, brushes, shaving equipment, and other objects which are typically used during showering or bathing. In addition to the internally mounted trays 22, the frame 20 also effectively supports an external tray 24, such as might be used for a toothbrush and toothpaste, an also has attached thereto a mirror 26.

Taking the internally supported tray more specifically designated **22*a*, it will of course be appreciated that the ability of the device 10 to function in both a vertical and horizontal mode is dependent upon being able to rotate each of the trays, as exemplified by tray 22*a*, through a rotative transverse of 90 degrees. That is, in converting from a shower accessory of FIG. 1 to a bath accessory of FIG. 2, which necessitates a change of orientation of 90 degrees, the position of tray 22*a* of FIG. 1 must be corespondingly rotated 90 degrees into its FIG. 2 position. Additionally, and again using tray 22*a* as an example, contributing to the utility of the device 10 is the ability to modify the lengthwise position along the frame 20** of the trays, as well as their rotative positions thereon.

Figure 1A:
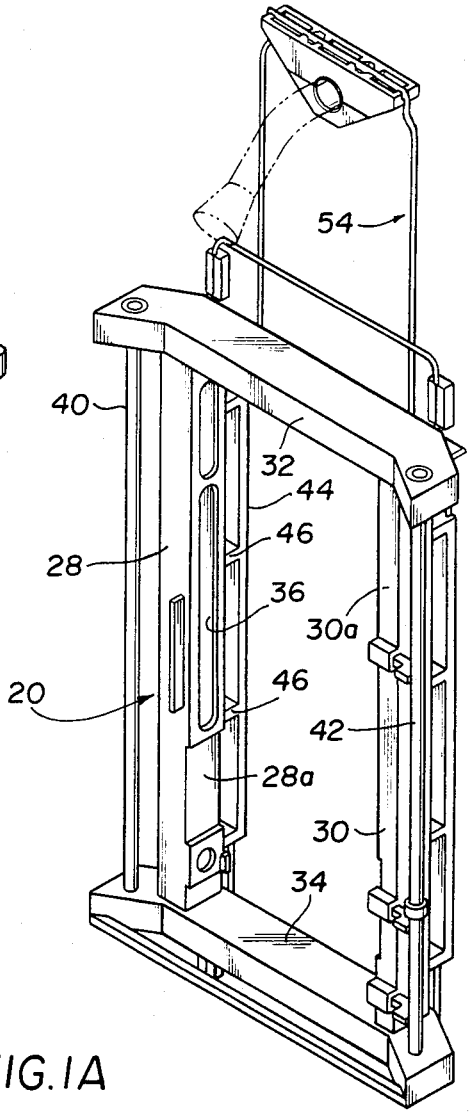
FIG. 1A is a view similar to FIG. 1, but illustrating the device without its trays and attachments, and thus beter illustrating details of the structural features of the frame body of the device.
Figure 2A:
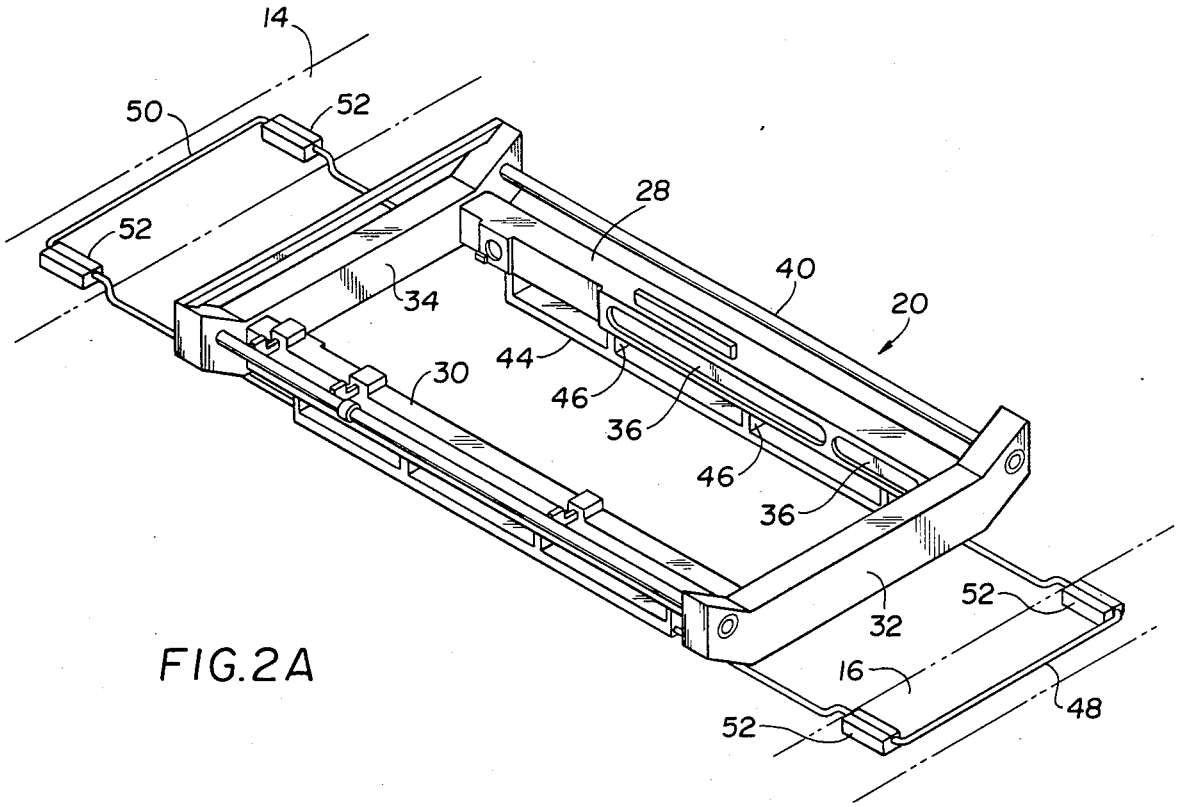
FIG. 2A is similar to FIG. 2, but with the trays and attachments removed to better illustrate structural details of the frame body.
Figure 3:
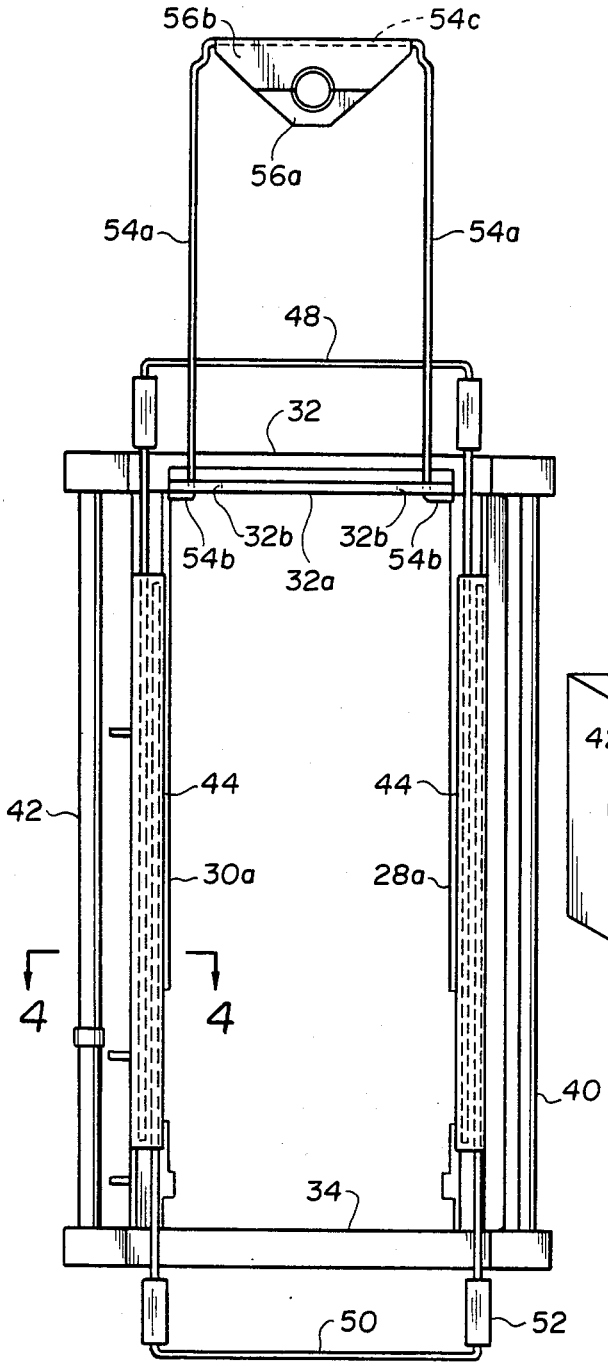
FIG. 3 is a rear elevational view of the device, without trays and attachments, illustrating structural details of the extendable supports from the frame body which permit use of the device in either the vertical or horizontal mode.
Figure 4:
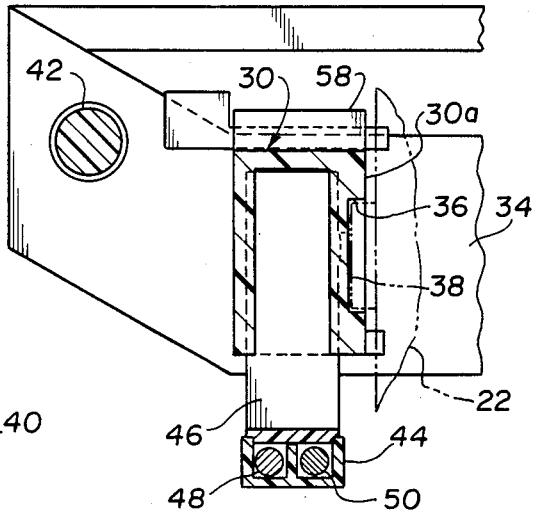
FIG. 4 is a partial elevational view, in section, taken along line 4—4 of FIG. 3, illustrating further structural details.

Referring now to the simplified version of the device 10, and, more particularly, the frame 20 thereof, as illustrated in FIGS. 1A and 2A, it will be better understood how the trays 22 are mounted internally of the frame 20 to partake both of rotative and sliding movement. Frame 20 is generally rectangular in shape and consists of two long sides 28 and 30 and two opposite end or short sides 32 and 34. In the faces **28*a* and 30*a* of the long sides which as shown in FIG. 1A are in facing relation to each other, there are slots, individually and collectively designated 36, which also are in facing relation with each other. Cooperating with the slots are cylindrical projections 38 (FIGS. 1 and 3) from each of the trays 22, 22*a* which are sized to be received within a cooperating slot 36. As a result, each tray 22, 22*a* can partake of sliding movement along the length of a cooperating slot 36, and also has a degree of rotative movement about the axis of the two cylindrical projections 38 which extend from opposite sides thereof. In this manner, the trays 22 are effectively mounted in spanning relation between the long sides 28 and 30 of the frame 20 while having degrees of movement lengthwise thereof and also through rotatable traverses consistent with the particular mode in which the device 20 is then being used. As shown in FIGS. 1 and 4, a shoulder 58 may be used to establish and fix a position of rotation for a cooperating tray 22**.

To accomodate externally mounted trays or attachments, as noted at 24 and 26, the construction of the frame 20 also contemplates the use of rods 40 and 42 mounted between lateral projections of the ends or sides 32 and 34, on which rods are placed the external trays and attachments 24, 26. The rods 40 and 42 also contribute to structural stability of the frame 20.

Either formed integral with or provided as an addition to the frame's long sides 28 and 30 is a construction 44 characterized by spaced walls 46 which are used to advantage to mount slidably extending supports for the frame 20. That is, and as best illustrated in FIG. 3, structure 44 is inserted from beneath into each side 28 and 30, with the walls 46 thereof having a snap or friction fit in aligning slots in said sides 28 and 30, and mounted for sliding movement in openings in these spaced walls 46 of each structure 44 are a cooperating pair of U-shaped wire supports 48 and 50 which are slidable from their storage positions as shown in FIG. 3 to extended positions, as shown in FIG. 2A, in which they engage the opposite bathtub sides 14 and 16, and thus mount the frame 20 in a horizontally spanning position between these bathtub sides. To prevent marring of the tub, pads 52 are placed on the wire supports.

In addition to the two supports 48 and 50, provision is also made for a third U-shaped wire support 54, which is used for vertically suspending device 10 when it is used as a shower accessory. To this end, the side 32 has a rearwardly extending lip **32*a* having at opposite ends two slots 32*b*. Being fabricated of a springly metal, the opposite sides 54*a* of the support 54 are readily squeezed slightly, so that the turned ends 54*b* are eased through the slots 32*b*, and the sides 54*a* then released so that the urgency of the springy construction material is effective to hold the support 54 in place. Using the shower nozzle 12 is an elevated support, it is contemplated that a two piece clamp 56*a*, 56*b* be appropriately mounted thereon and that a slot in the upper clamp piece 56*b* then be used to seat the upper leg 54*c* of the support 54**.

A latitude of modification, change and substitution is intended in the foregoing disclosure and in some instance some features of the invention will be employed without a corresponding use of other features. Accordingly, it is appropriate that the appended claims be construed broadly and in a manner consistent with the spirit and scope of the invention herein.

What is claimed is:

1. An article of manufacture for combined use as a bath and shower accessory comprising a rectangular frame having in the long sides thereof a pair of opposing faces each having at least one longitudinally oriented slot therein, plural trays mounted in spanning relation between said frame long sides having opposite cylindrical lateral projections operatively disposed in said slots for selected sliding movement therealong and rotative movement about the axis of said cylindrical lateral projections, and slidable supports extendable in opposite directions from said frame such that when a cooperating pair thereof is in extended position said frame is adapted to be horizontally supported thereon and when only one said support is in its extended position, said frame is adapted to be vertically suspended therefrom, whereby said horizontally supported frame with said trays in one rotative position is adapted to be supported in spanning relation between the sides of a bathtub when serving as a bath accessory and also is adapted when vertically suspended from a support with said trays in a 90 degree rotated position to serve as a shower accessory.

2. The combination bath and shower accessory as claimed in claim 1, including a pair of upper and lower clamp members adapted to be disposed in clamped relation about a shower nozzle, and a groove in said upper clamp member adapted to have seated therein said single support extended from said accessory preparatory to the use thereof in its vertical orientation.

* * * * *